US008438769B1

(12) United States Patent
Ghannam

(10) Patent No.: US 8,438,769 B1
(45) Date of Patent: May 14, 2013

(54) WEAPONS FOREGRIP

(76) Inventor: Chris S. Ghannam, Estero, FL (US)

( * ) Notice: Subject to any disclaimer, the term of this patent is extended or adjusted under 35 U.S.C. 154(b) by 0 days.

(21) Appl. No.: 12/906,500

(22) Filed: Oct. 18, 2010

Related U.S. Application Data

(60) Provisional application No. 61/252,458, filed on Oct. 16, 2009.

(51) Int. Cl.
*F41C 23/14* (2006.01)

(52) U.S. Cl.
USPC ..... 42/71.01; 42/72; 42/74; 16/430

(58) Field of Classification Search ..... 42/72, 71.01, 42/85, 74; 16/430
See application file for complete search history.

(56) References Cited

U.S. PATENT DOCUMENTS 1,503,251 A * 7/1924 Schoof ..... 111/99
6,622,416 B2 * 9/2003 Kim ..... 42/146

* cited by examiner

*Primary Examiner* — Daniel J Troy
(74) *Attorney, Agent, or Firm* — Nilay J. Choksi; Ronald E. Smith; Smith & Hopen, P.A.

(57) ABSTRACT

A foregrip for a firearm includes a grip formed to fit in a palm of a hand having a first cavity for receiving an index finger disposed at a forward portion on a first side of the grip and a second cavity for receiving a thumb disposed on a second side of the grip, the first cavity being substantially vertical and the second cavity being substantially horizontal. In a first embodiment, the foregrip further includes a plurality of horizontal grooves for receiving a middle, ring, and little finger disposed at a back portion on the first side of the grip. In a second embodiment, the foregrip further includes a cavity for receiving a ring and little finger disposed at a back portion of said first side of said grip and a notch for receiving a middle finger.

6 Claims, 12 Drawing Sheets

WEAPONS FOREGRIP

CROSS REFERENCE TO RELATED APPLICATION

This application claims priority to currently pending U.S. provisional patent application No. 61/252,458, entitled "WEAPONS FOREGRIP," filed on Oct. 16, 2009, the contents of which are hereby incorporated by reference.

BACKGROUND OF THE INVENTION

1. Field of the Invention

This invention relates to a foregrip for a firearm. More particularly, it relates to a foregrip for a firearm for placing a shooter in a physiologically correct posture, for mitigating said shooter's dependence on fine motor skills, and for mitigating the effects of sympathetic reflex for improved shooting accuracy.

2. Description of the Prior Art

Ever since the advent of the firearm, it has been a major problem to obtain the best accuracy possible in shooting thereof, particularly for military personnel and law enforcement officers who are operating under high stress situations. While manufacturers have attempted to create foregrips that provide a shooter with control over the firearm, conventional horizontal foregrips work against proper shooting alignment by creating excessive muscle fatigue and encouraging unwanted twisting and movement in the shooting and support arm.

A major problem created by conventional horizontal foregrips is unnecessary support arm tension that creates a sympathetic reflex in the indexed trigger finger, resulting in involuntary twisting and movement of the firearm. The excessive pressure placed on the trigger finger prior to and during discharge is also known as slapping the trigger. Conventional horizontal foregrips also induce excess fatigue in the support arm and force the shooter into poor shooting posture. Such involuntary twisting, movement, fatigue, and poor posture can be disastrous; even the slightest degree of inaccuracy can result in unintended casualties, especially as the battlefield moves to more populated urban settings. According to the FBI's well documented deadly force literature, an officer under stress only hits an intended target roughly 17% of the time.

Like conventional horizontal foregrips, vertical foregrips work against proper shooting alignment by not taking into consideration the effects of sympathetic reflex and muscular tension within the support hand. Moreover, vertical foregrips do not account for the many externalities associated with high stress precision shooting, including shooter dexterity, strength, kit design, and the rapidly changing tactical environments requiring rapid modifications in tactics and postures. In fact, vertical foregrips only exacerbate the aforementioned problems of conventional horizontal foregrips and increase the likelihood of shooting inaccuracy.

What is needed is a foregrip that automatically (without conscious awareness) places a shooter in a physiologically correct posture for improved shooting accuracy and removes the over dependency on fine and complex motor skill functionality required for high stress precision shooting.

What is also needed is a foregrip that places portions of the upper extremity of the body involved in shooting into an ideal physiological posture to promote rapid and dependable replication.

What is further needed is a foregrip that provides increased control over the weapon system being used, promotes relaxation, and mitigates sympathetic reflex.

However, in view of the prior art considered as a whole at the time the present invention was made, it was not obvious to those of ordinary skill in the art how the limitations of the art could be overcome.

SUMMARY OF THE INVENTION

The long-standing but heretofore unfulfilled need for an improved weapons foregrip that allows a shooter to maintain optimal weapon control within a controlled, relaxed, and physiologically correct posture is now met by a new, useful, and nonobvious invention.

In a first embodiment, the novel foregrip includes a grip formed to fit in a palm of a hand. The grip includes a first side, a second side, a top portion, a bottom portion, a front portion, and a back portion. A first cavity for receiving an index finger is disposed at a forward position on the first side of the grip. The first cavity is substantially vertical and isolates the index finger from the middle, ring, and little fingers. A plurality of horizontal grooves for receiving a middle, ring, and little finger is disposed at a back portion on the first side of the grip. The plurality of horizontal grooves accommodates different hand sizes. A second cavity for receiving a thumb is disposed on the second side of the grip. The second cavity is substantially horizontal and includes spatial contours to guide the thumb slightly outward at the tip.

The first embodiment may further include the top portion of the grip being thicker than the bottom portion of the grip. As a result, the grip gradually reduces in thickness from the top portion to the bottom portion to comfortably fit within the palm of a hand.

The first embodiment may further include the plurality of horizontal grooves being disposed in vertical, abutting relation to one another. Accordingly, due to the gradual reduction in the thickness of the grip from the top portion to the bottom portion, the plurality of horizontal grooves gradually descend inward from the top portion of the grip to the bottom portion of the grip.

In a second embodiment, the novel foregrip includes a grip formed to fit in a palm of a hand. The grip includes a first side, a second side, a top portion, a bottom portion, a front portion, and a back portion. A first cavity for receiving an index finger is disposed at a forward portion on the first side of the grip. The first cavity is substantially vertical and isolates the index finger from the middle, ring, and little fingers. A second cavity for receiving a ring and little finger is disposed at a back portion of the first side of the grip. The second cavity is also substantially vertical. A notch is disposed between the first cavity and the second cavity on the first side of the grip. The notch is for the placement of a middle finger. A third cavity for receiving a thumb is disposed on the second side of the grip. The third cavity is substantially horizontal and includes spatial contours to guide the thumb slightly outward at the tip.

The second embodiment may further include the top portion of the grip being thicker than the bottom portion of the grip. As a result, the grip gradually reduces in thickness from the top portion to the bottom portion to comfortably fit within the palm of a hand.

The novel foregrip is retrofit to the barrel of a firearm as an aftermarket product or it can be provided as original equipment. Furthermore, the novel foregrip is compatible with firearm accessories (e.g., a laser or flashlight) and provides a platform for all accessories to reside internally within the foregrip, which assist in the control, placement, and overall weight distribution of the weapon.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
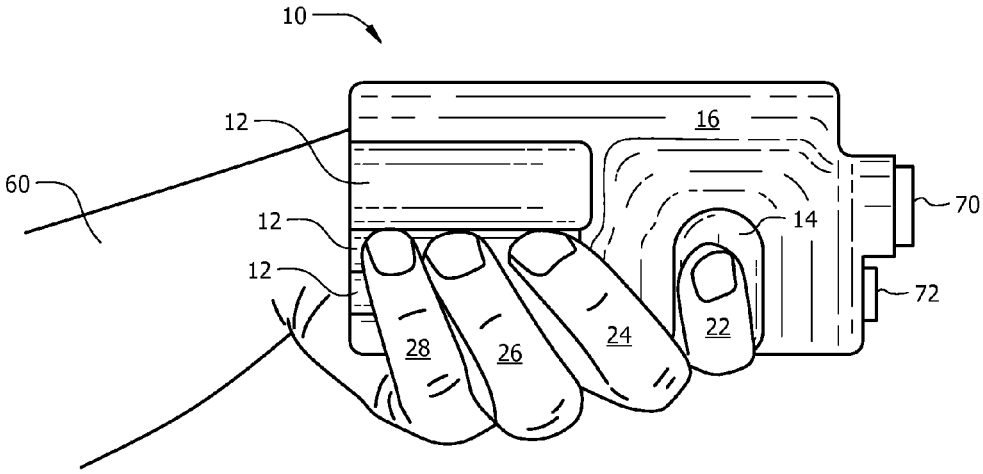
FIG. 1 is a first side view of a first embodiment of a novel foregrip being held by a shooter.

The following detailed description discloses the preferred embodiments of a novel foregrip and shall be interpreted as illustrative and not in a limiting sense. Moreover, in the following detailed description, reference is made to the front, back, top, and bottom of the novel foregrip. This orientation is in reference to a shooter holding a firearm and shooting in a typical shooting position, i.e., facing a target and shooting away from the body.

The novel foregrip enables the shooter to maintain optimal shooting posture under stress without conscious awareness, significantly reduces muscle fatigue, mitigates the effects of sympathetic reflex, and directly isolates joints within the shooter's support arm to reduce movement and improve shooting accuracy. Illustrative embodiments of the novel foregrip are denoted as a whole in the drawings by the reference numeral 10.

Figure 2:
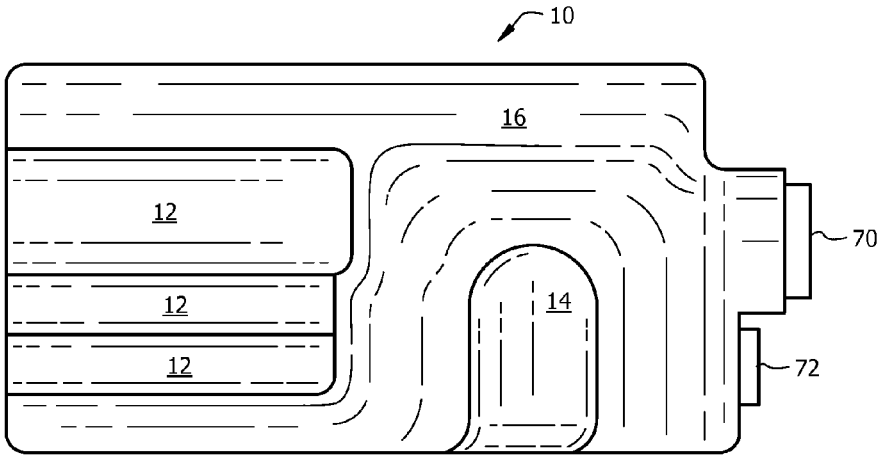
FIG. 2 is a first side view of a first embodiment of a novel foregrip.

In a first embodiment, as depicted in FIGS. 1 and 2, first side 16 of foregrip 10 includes index finger cavity 14 and horizontal grooves 12. Index finger cavity 14 is disposed at a front portion of foregrip 10 in a substantially vertical orientation. Index finger cavity 14 isolates index finger 22 from middle finger 24, ring finger 26, and little finger 28. By isolating index finger 22 from the other fingers, foregrip 10 mitigates the negative effects of sympathetic reflex in relation to precision shooting and index finger tension. Moreover, by isolating index finger 22, foregrip 10 mitigates a shooters ability to fully clench around foregrip 10, thereby decreasing tension in support arm 60 while still permitting optimal control over the weapon. Index finger cavity 14 ensures that index finger 22 remains in a relaxed, repose position while foregrip 10 is gripped.

Still referring to FIGS. 1 and 2, horizontal grooves 12 are disposed at a back portion of foregrip 10 in a substantially horizontal orientation. Middle finger 24, ring finger 26, and little finger 28 are placed within horizontal grooves 12 and are isolated from index finger 22. Horizontal grooves 12 are disposed in vertical, continuous relation to one another. By separating middle finger 24, ring finger 26, and little finger 28 from index finger 22, middle finger 24, ring finger 26, and little finger 28 are able to grip foregrip 10 without convey excess tension to index finger 22.

A plurality of horizontal grooves is provided to accommodate a variety of hand sizes. For example, as depicted in FIG. 1, a shooter with an average sized hand will place middle finger 24, ring finger 26, and little finger 28 in middle horizontal groove 12. Similarly, a shooter with a smaller sized hand will place middle finger 24, ring finger 26, and little finger 28 in bottom horizontal groove 12 (not shown), and a shooter with a larger sized hand will place middle finger 24, ring finger 26, and little finger 28 in upper horizontal groove 12 (not shown).

Figure 3:
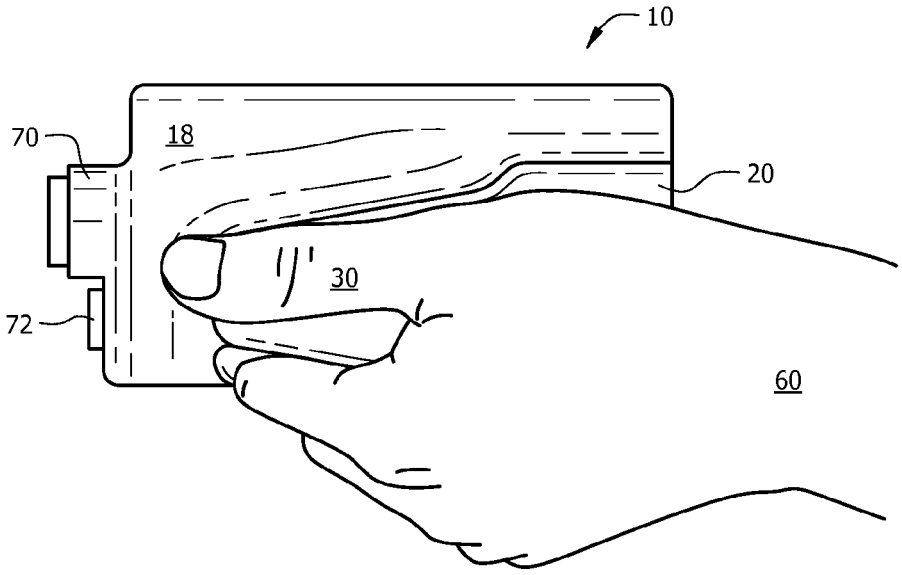
FIG. 3 is a second side view of a first embodiment of a novel foregrip being held by a shooter.
Figure 4:
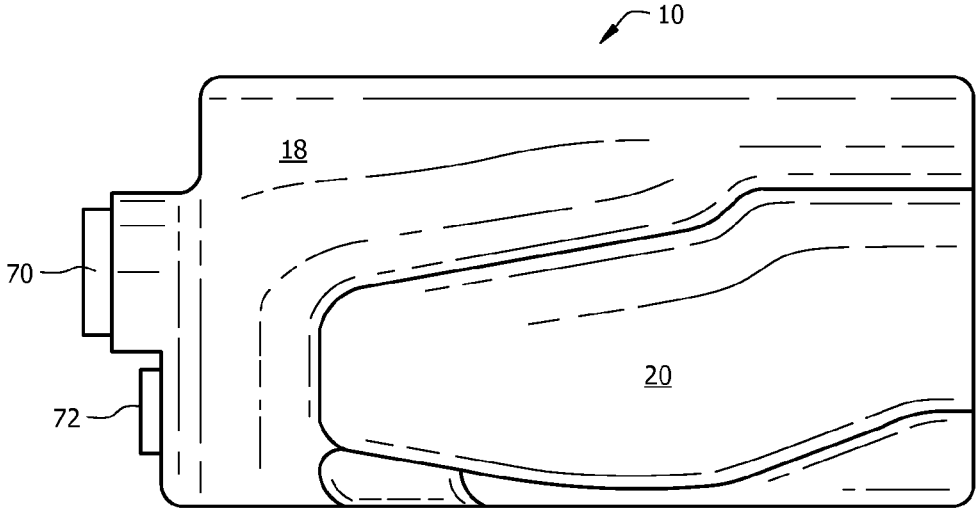
FIG. 4 is a second side view of a first embodiment of a novel foregrip.

As depicted in FIGS. 3 and 4, second side 18 of foregrip 10 includes thumb cavity 20. Thumb cavity 20 is substantially horizontal in orientation and is adapted to receive thumb 30. Thumb cavity 20 includes spatial contours to guide the thumb slightly outward at the tip. In an embodiment, within thumb cavity 20, the spatial contours progress from a shallow indent near the proximal end of thumb 30 to a deeper indent near the middle of thumb 30 and back out to a shallow indent at the distal end of thumb 30, i.e., the spatial contour is formed to match the natural contours of thumb 30 pressed within thumb cavity 20.

When disposed within thumb cavity 20, thumb 30 is substantially horizontal in orientation. Moreover, thumb 30 slants slightly outward at the tip to prevent thumb 30 from clamping towards the barrel and pitching the weapon in the "X" axis, thereby placing a shooter into a physiologically correct posture to minimize unwanted pitching and eliminate unwanted movement of support arm 60 for maximum accuracy and precision under stress.

Figure 5:
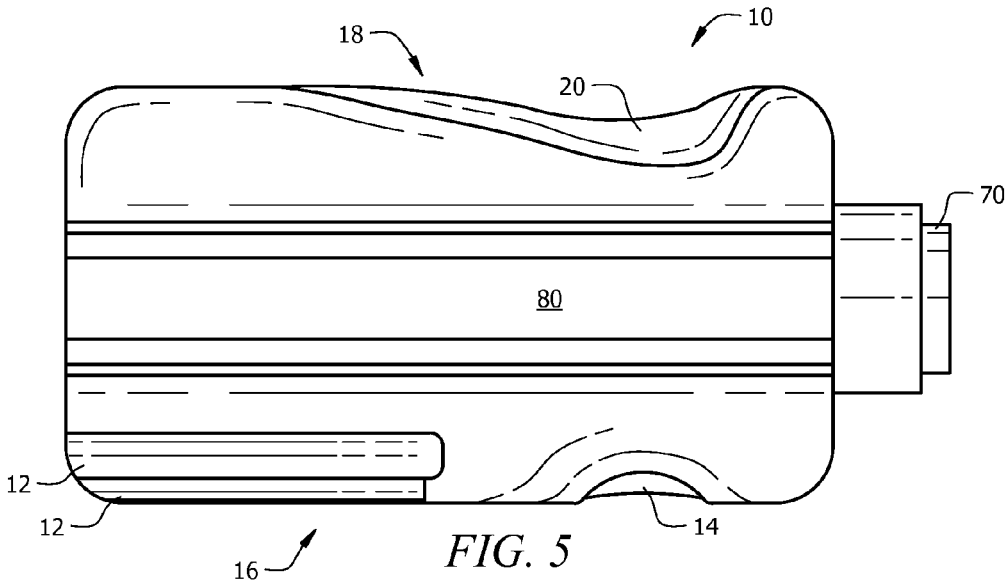
FIG. 5 is a top view of a first embodiment of a novel foregrip.

FIG. 5 depicts a top view of foregrip 10. The top portion of foregrip 10 includes attachment means 80 for attaching foregrip 10 to a firearm. Attachment means 80 may include a rail system, such as, but not limited to, a PICATINNY™ rail. In such an embodiment, foregrip 10 is slid onto the rail system and fastened into place. These types of attachments systems are well known in the art. In addition, foregrip 10 may be a hollow structure that is positioned around and fastened to the stock of a firearm.

Figure 6:
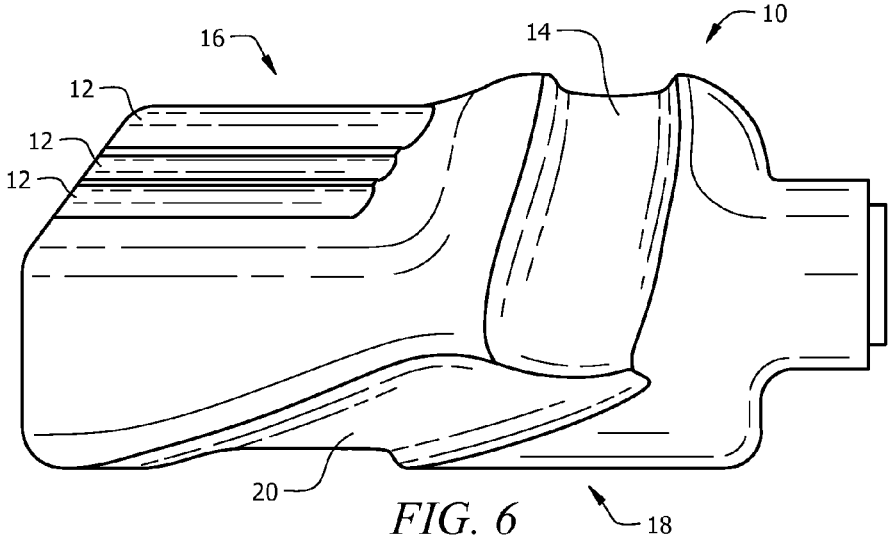
FIG. 6 is a bottom view of a first embodiment of a novel foregrip.

As depicted in FIG. 6, because foregrip 10 fits comfortably within a palm of a hand, thumb cavity 20 of second side 18 is contoured to naturally wrap around the thumb. Similarly, index finger cavity 14 is contoured to naturally wrap around the index finger.

Figure 7:
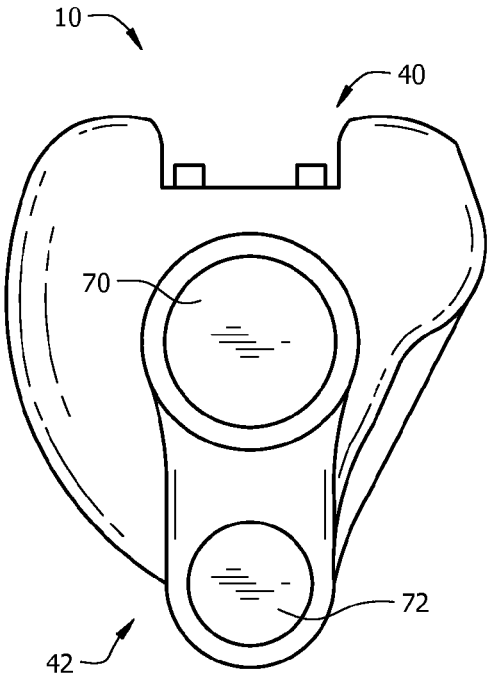
FIG. 7 is a front view of a first embodiment of a novel foregrip.
Figure 8:
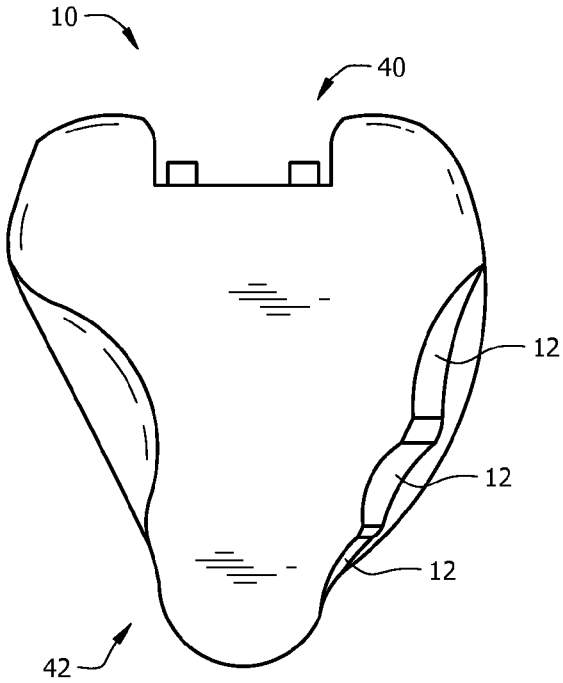
FIG. 8 is a back view of a first embodiment of a novel foregrip.

As depicted in FIGS. 7 and 8, top portion 40 of foregrip 10 is thicker than bottom portion 42. As a result, foregrip 10 gradually reduces in thickness from top portion 40 to bottom portion 42 to comfortably fit within a palm of a hand. Moreover, as depicted in FIG. 8, horizontal grooves 12 are disposed in vertical, contiguous relation to one another. Due to the gradual reduction in the thickness of foregrip 10 from top portion 40 to bottom portion 42, horizontal grooves 12 gradually descend inward from top portion 40 to the bottom portion 42 of said foregrip 10.

As depicted in FIGS. 1-7, foregrip 10 includes generic accessory attachment locations 70 and 72. It is common practice in the art to attach shooting accessories, such as flashlights and lasers, to grips or weapon systems. Foregrip 10, however, is adapted to accommodate complete closure of such devices to deter acts of corrosion due to weather, sand, impact, and overall cumbersomeness. Foregrip 10 allows for seemless attachment/de-tactchment of accessories without disrupting weapon system weight distribution. Such accessories may be attached to foregrip 10 or, alternately, built into foregrip 10.

Figure 9:
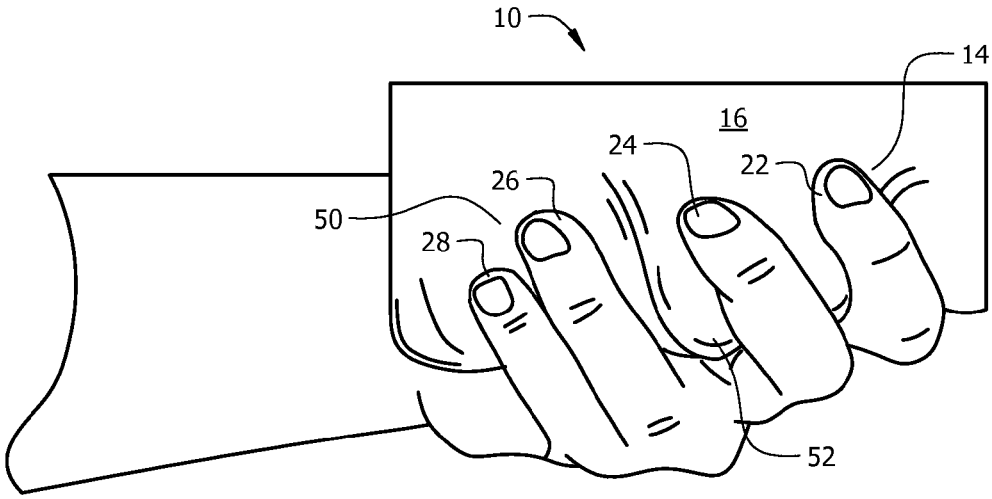
FIG. 9 is a first side view of a second embodiment of a novel foregrip being held by a shooter.
Figure 10:
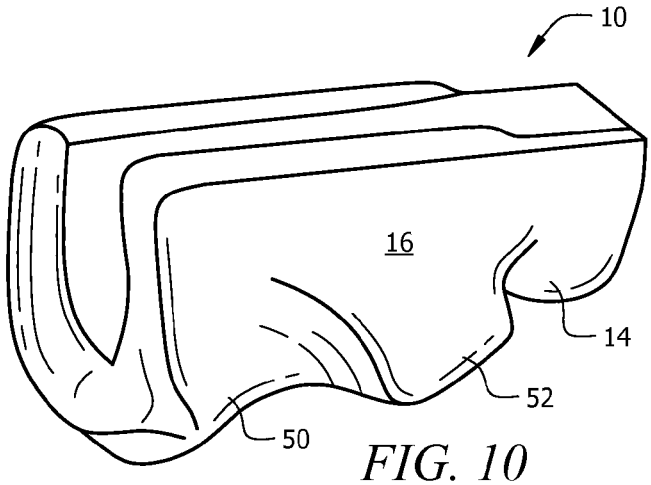
FIG. 10 is an upper perspective first side view of a second embodiment of a novel foregrip.

In a second embodiment, as depicted in FIGS. 9 and 10, first side 16 of foregrip 10 includes index finger cavity 14 and ring and little finger cavity 50. Index finger cavity 14 is disposed at a front portion of foregrip 10 in a substantially vertical orientation. Index finger cavity 14 isolates index finger 22 from middle finger 24, ring finger 26, and little finger 28. By isolating index finger 22 from the other fingers, foregrip 10 mitigates the negative effects of sympathetic reflex in relation to precision shooting and index finger tension. Moreover, by isolating index finger 22, foregrip 10 mitigates a shooters ability to fully clench around said foregrip 10, thereby decreasing tension in support arm 60 while still maintaining optimal control over weapon system.

Middle finger notch 52 is disposed between index finger cavity 14 and ring and little finger cavity 50 and separates the two cavities. Middle finger 24 is disposed on middle finger notch 52.

Figure 11:
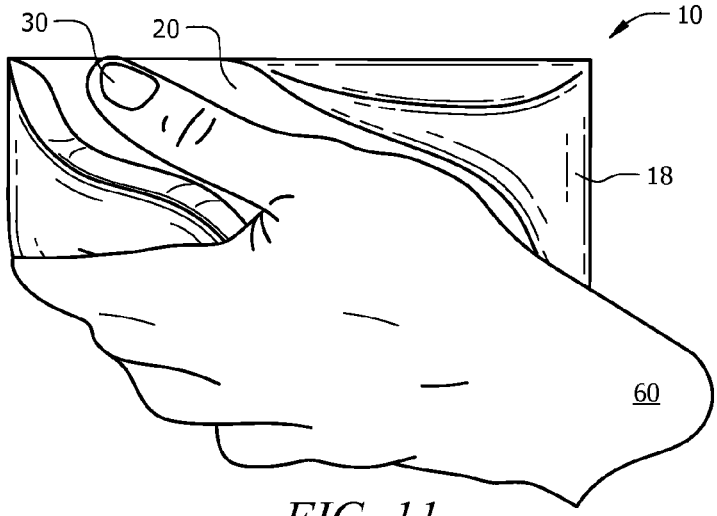
FIG. 11 is a second side view of a second embodiment of a novel foregrip being held by a shooter.
Figure 12:
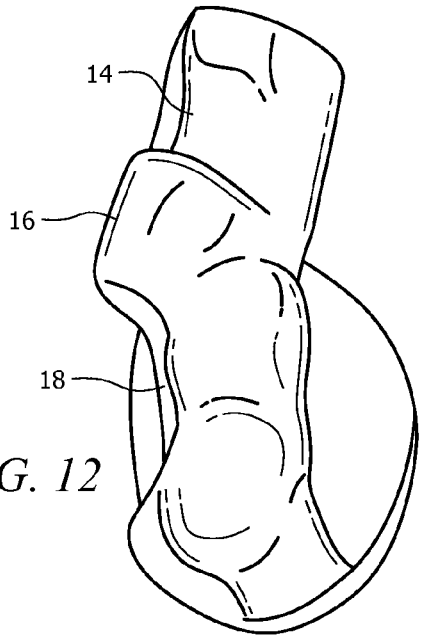
FIG. 12 is a bottom view of a second embodiment of a novel foregrip.
Figure 13:
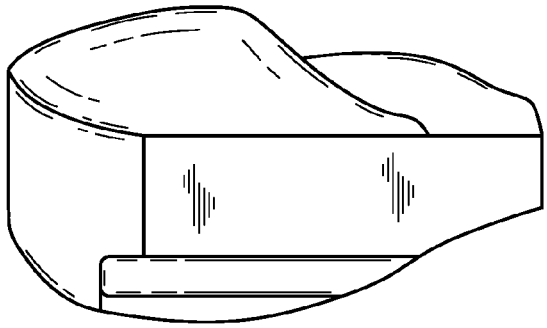
FIG. 13 is a top view of a second embodiment of a novel foregrip.
Figure 14:
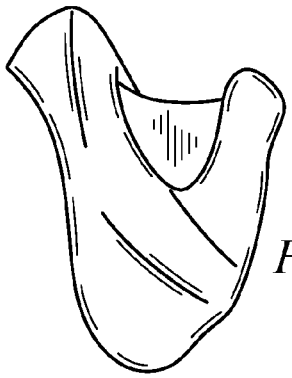
FIG. 14 is a back view of a second embodiment of a novel foregrip.

As depicted in FIG. 11, second side 18 of foregrip 10 includes thumb cavity 20. Thumb cavity 20 is substantially horizontal in orientation and is adapted to receive thumb 30. Thumb cavity 20 includes spatial contours to guide the thumb slightly outward at the tip. In an embodiment, within thumb cavity 20, the spatial contours progress from a shallow indent near the proximal end of thumb 30 to a deeper indent hear the middle of thumb 30 and back out to a shallow indent at the distal end of thumb 30, i.e., the spatial contour is formed to match the natural contours of thumb 30.

When disposed within thumb cavity 20, thumb 30 is substantially horizontal in orientation, slanting slightly outward at the tip to prevent thumb 30 from clamping towards the barrel and pitching the weapon in the "X" axis, thereby placing a shooter into a physiologically correct posture to minimize unwanted pitching and eliminate unwanted movement of support arm 60 for maximum accuracy and precision under stress.

Figure 15:
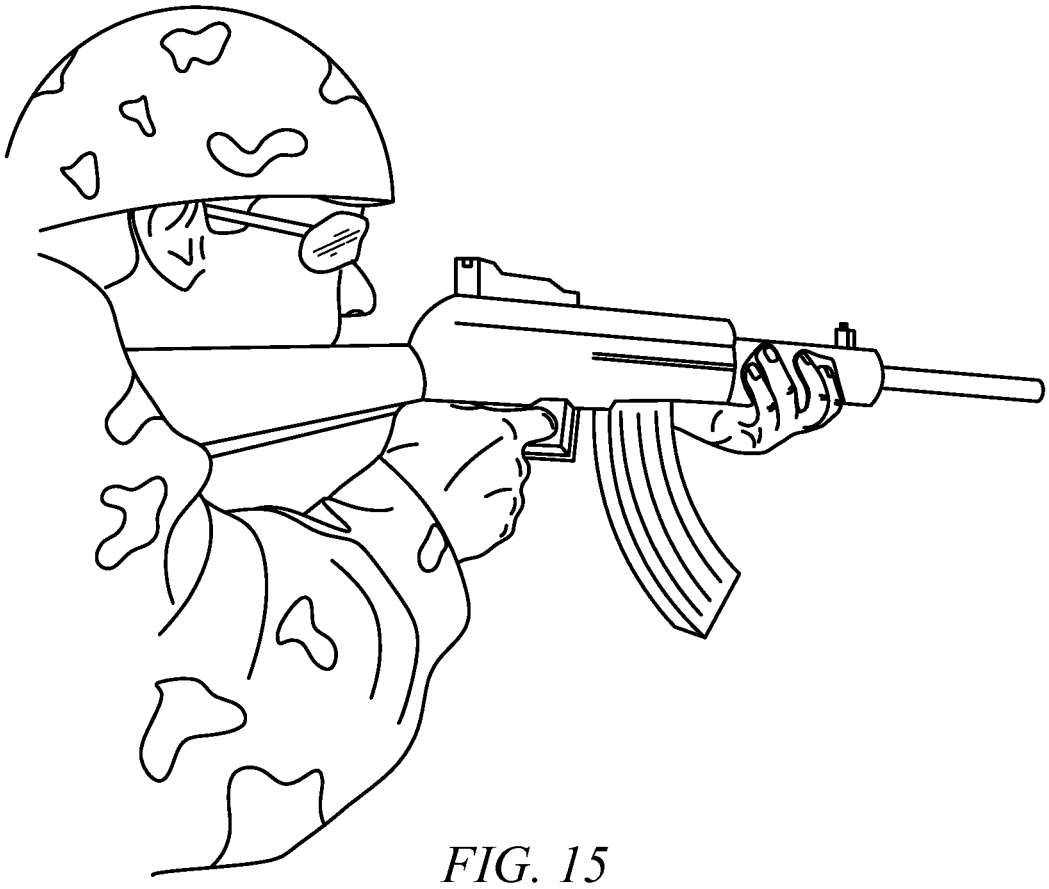
FIG. 15 is a perspective view of an embodiment of a novel foregrip incorporated into a firearm being fired.
Figure 16:
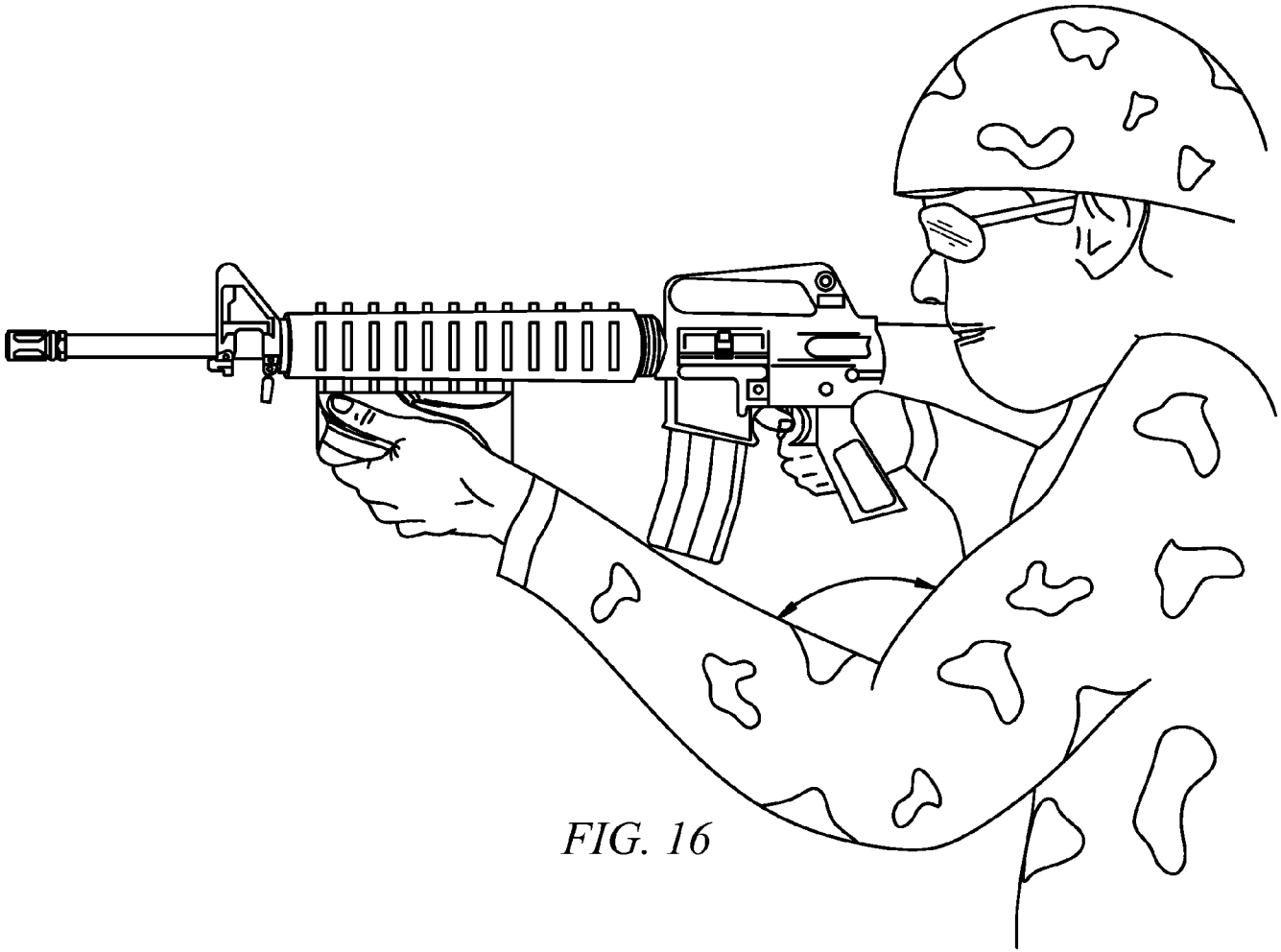
FIG. 16 is a perspective view of an embodiment of a novel foregrip incorporated into a firearm being fired.

Foregrip 10 enables a shooter to maintain optimal weapon control within a controlled, relaxed, and physiologically correct posture, as depicted in FIGS. 15 and 16. Specifically, as depicted in FIG. 16, the novel foregrip isolates the joints within the support arm and purposely targets the largest muscle group, Biceps Brachii, of the support arm to significantly decrease muscle fatigue. By isolating the joints and decreasing muscle fatigue, the shooter is placed in—and can maintain—a physiologically correct posture for extended periods of time without conscious awareness of arm placement required.

Figure 17:
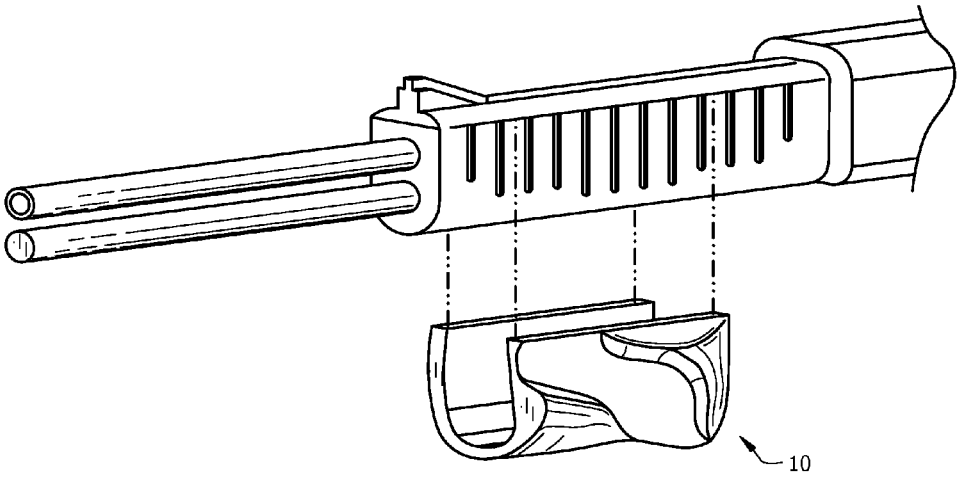
FIG. 17 is a perspective view of an embodiment of a novel foregrip incorporated into a firearm.
Figure 18:
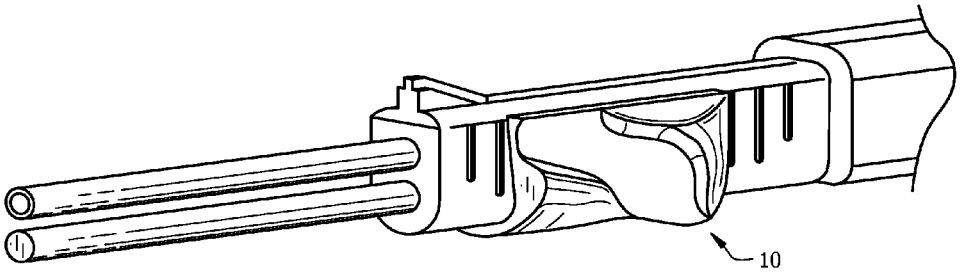
FIG. 18 is a perspective view of an embodiment of a novel foregrip incorporated into a firearm.
Figure 19:
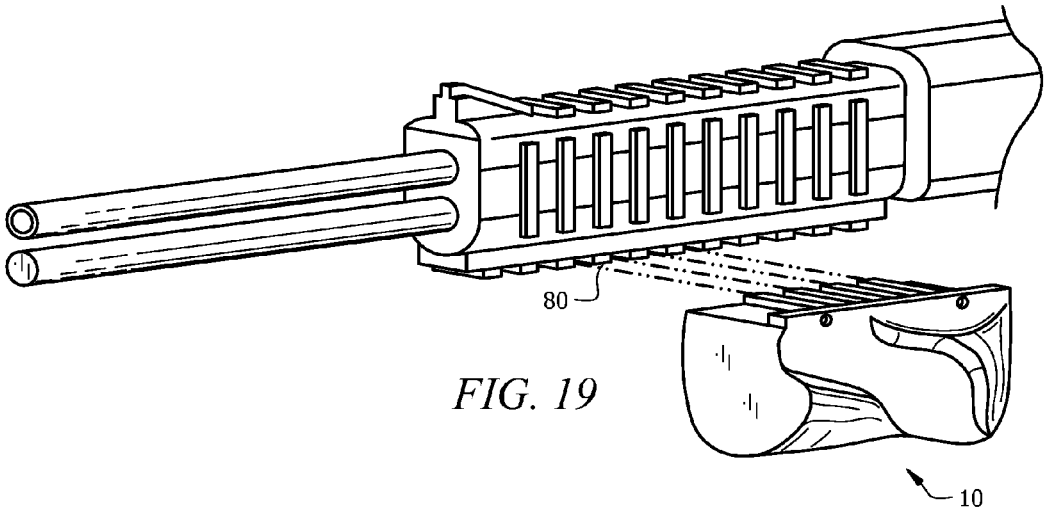
FIG. 19 is a perspective view of an embodiment of a novel foregrip incorporated into a firearm.
Figure 20:
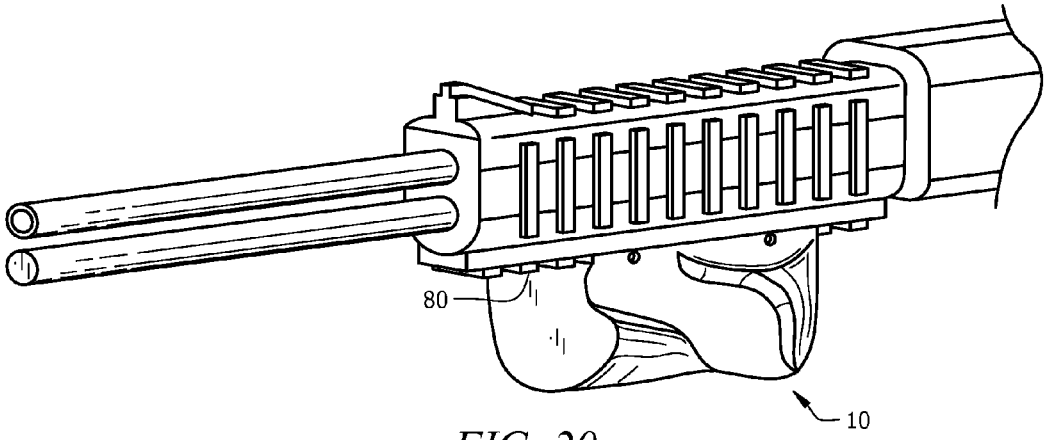
FIG. 20 is a perspective view of an embodiment of a novel foregrip incorporated into a firearm.
Figure 21:
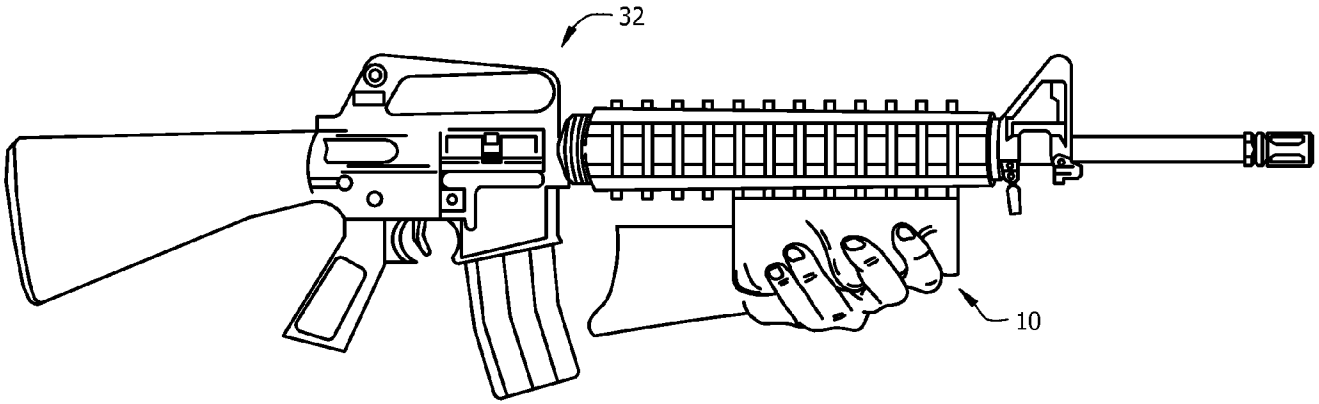
FIG. 21 is a perspective view of an embodiment of a novel foregrip incorporated into a firearm.
Figure 22:
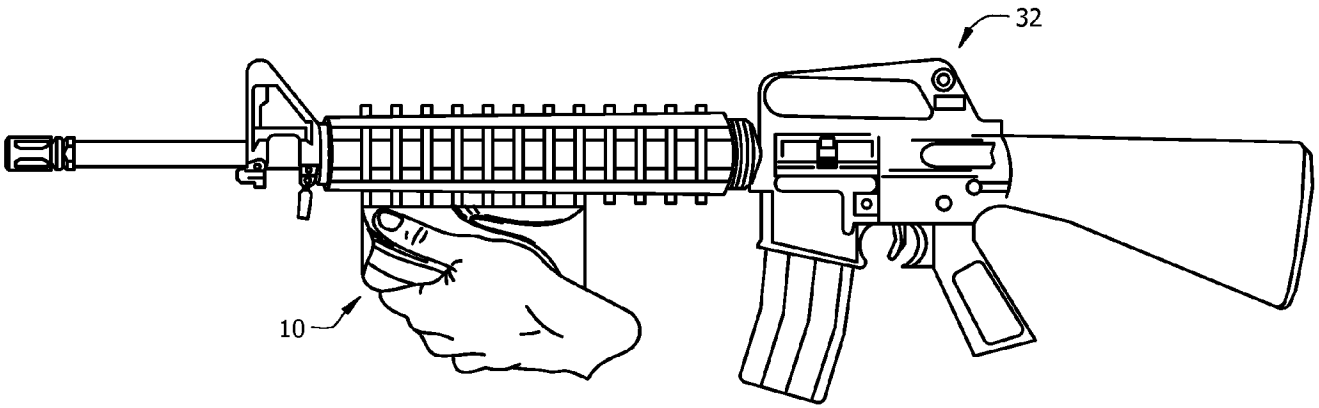
FIG. 22 is a perspective view of an embodiment of a novel foregrip incorporated into a firearm.
Figure 23:
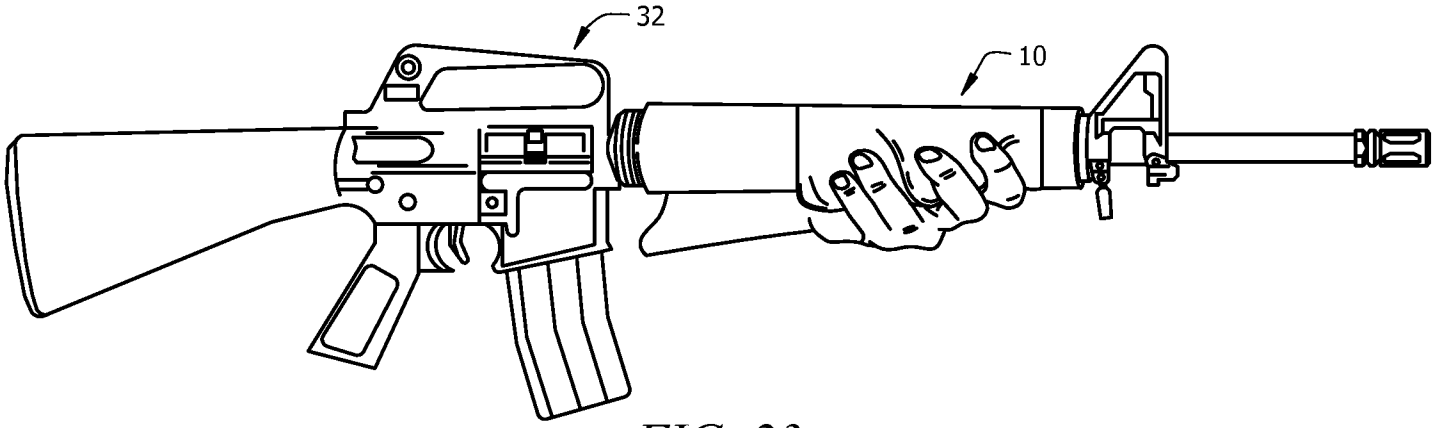
FIG. 23 is a perspective view of an embodiment of a novel foregrip incorporated into a firearm.
Figure 24:
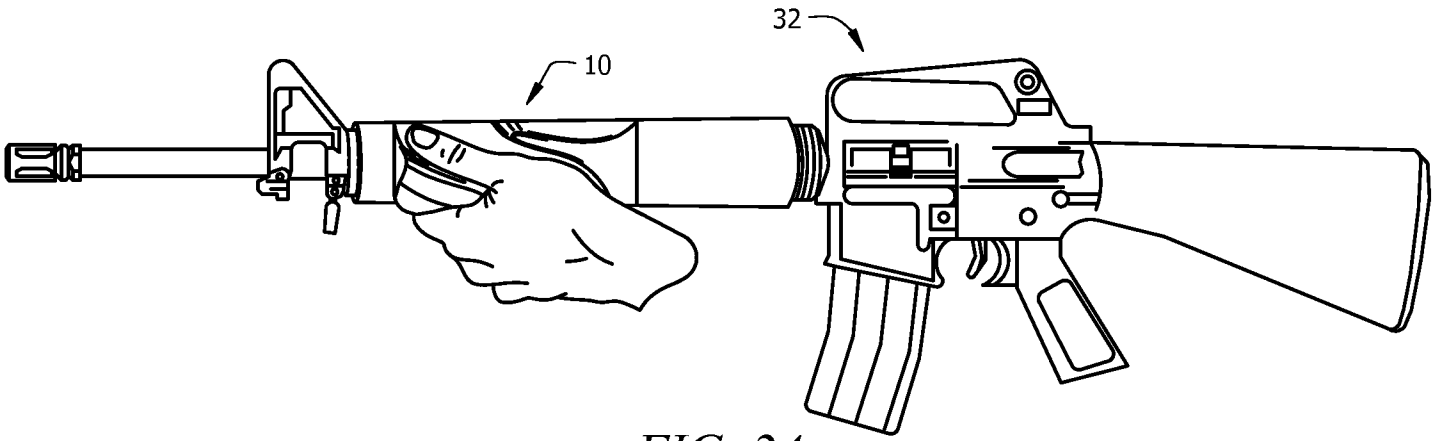
FIG. 24 is a perspective view of an embodiment of a novel foregrip incorporated into a firearm.

Foregrip 10 is attached to the barrel of a firearm as an aftermarket product or can made as a complete assembly. For example, as depicted in FIGS. 17 and 18, foregrip 10 includes a "U"-shaped interior which enables foregrip 10 to be placed around the barrel of a firearm. The interior of foregrip 10, however, may be any shape that permits the users to place the foregrip around the barrel of a firearm. Similarly, as depicted in FIGS. 19-22, foregrip 10 is compatible with rail system 80, such as, but not limited to, a PICATINNT™ rail. In this embodiment, foregrip 10 is slid onto rail system 80 and fastened into place. In contrast, as depicted in FIGS. 23 and 24, foregrip 10 is built into firearm 32 as a complete foregrip assembly single unit.

The novel foregrip isolates the phalanges, metacarpals, and carpals into a perfect shooting alignment and prevents unwanted movement within the hand. Moreover, the spatial alignment of the fingers mitigates the negative effects of sympathetic reflex and mitigates the shooter's ability to fully clench around the weapon which causes an increase in support arm tension. Accordingly, the novel foregrip enables a shooter to maintain optimal weapon control within a controlled, relaxed, and physiologically correct posture.

In particular, the vertical index finger cavity isolates the index finger from the ring, middle, and little finger. The isolation of the index fingers allows for the remaining fingers to grasp around the grip without conveying increased tension to the index finger. Because the index finger is in a relaxed, repose position, the negative effects of sympathetic reflex are diminish, i.e., the trigger finger is also relaxed. Moreover, the horizontal thumb cavity places the thumb in a substantially horizontal position and prevents the thumb from clinching around the grip causing unwanted movement.

The novel foregrip is depicted for right handed shooters. However, in an inverse embodiment, the foregrip is compatible with left handed shooters.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween.

What is claimed is:

1. A foregrip for a firearm, comprising:

a grip adapted to fit in a palm of a hand of a user, said grip having a first side, a second side, a top wall, a bottom wall, a front wall, and a back wall;

said grip having a predetermined longitudinal extent, a predetermined height extent, and a predetermined transverse extent;

an index finger groove for receiving an index finger, said index finger groove continuously formed in said first side of said grip, said bottom wall of said grip, and said second side of said grip, said index finger groove having a predetermined height extent in said first side, a transverse extent in said bottom wall, and a predetermined height extent in said second side that is less than the predetermined height extent in said first side;

a first longitudinally extending groove formed in said first side having a trailing end in open communication with said back wall and a leading end spaced apart from and in trailing relation to said index finger groove;

a second longitudinally extending groove formed in said first side having a trailing end in open communication with said back wall and a leading end spaced apart from and in trailing relation to said index finger groove;

a third longitudinally extending groove formed in said first side having a trailing end in open communication with said back wall and a leading end spaced apart from and in trailing relation to said index finger groove;

a thumb groove for receiving a thumb formed in said second side of said grip, said thumb groove having a trailing end in open communication with said back wall and a leading end spaced apart from said front wall by substantially the same distance that said index finger groove is spaced from said front wall;

whereby said foregrip is configured to be attached to a rail or forestock region of said firearm.

2. A weapons foregrip as in claim 1, further comprising:

said first, second, and third longitudinally extending grooves being disposed in vertically stacked, contiguous relation to one another, said second and third longitudinally extending grooves having a common height extent and said first longitudinally extending groove having a greater height extent than said common height extent of said second and third longitudinally extending grooves.

3. A weapons foregrip as in claim 1, further comprising:

said top wall of said grip having a greater transverse extent than said bottom wall of said grip, said grip gradually reducing in transverse extent from said top wall to said bottom wall so that said grip is adapted to comfortably fit within said palm of said hand.

4. A weapons foregrip as in claim 3, further comprising:

said first, second, and third longitudinally extending grooves being disposed in vertically stacked, contiguous relation to one another.

5. A weapons foregrip as in claim 1, further comprising:

a means of attaching said grip to a firearm;

said mean forming a part of said top wall.

6. A weapons foregrip as in claim 1, further comprising:

an attachment mechanism for attaching accessories externally to said grip.

* * * * *